United States Patent [19]

Simpson

[11] 4,435,369

[45] Mar. 6, 1984

[54] HYDROMETALLURGICAL PROCESS FOR EXTRACTION OF NICKEL

[76] Inventor: Charles H. Simpson, 7749 E. Chaparrel Rd., Scottsdale, Ariz. 85253

[21] Appl. No.: 402,977

[22] Filed: Jul. 29, 1982

Related U.S. Application Data

[63] Continuation-in-part of Ser. No. 275,763, Jun. 22, 1981.

[51] Int. Cl.[3] ..... C01G 53/09

[52] U.S. Cl. ..... 423/147; 423/150; 75/101 R; 75/110; 75/119

[58] Field of Search ..... 423/150, 147; 75/101 R, 75/119, 110

[56] References Cited

U.S. PATENT DOCUMENTS

| | | | |
|---|---|---|---|
| 732,641 | 6/1903 | Joseph | 75/101 R |
| 2,105,456 | 1/1938 | Hubler | 423/151 |
| 2,341,873 | 2/1944 | Kissock | 423/150 |
| 3,130,043 | 4/1964 | Lichty | 423/150 |
| 3,466,144 | 9/1969 | Kay | 423/150 |
| 3,793,430 | 2/1974 | Weston | 423/150 |

*Primary Examiner*—Earl C. Thomas
*Assistant Examiner*—Robert L. Stoll
*Attorney, Agent, or Firm*—Drummond & Nissle

[57] ABSTRACT

A hydrometallurgical process for extracting nickel from comminuted nickel-bearing minerals. The process includes the steps of contacting the comminuting nickel-bearing minerals in an extraction zone with an aqueous solution having a concentration of chloride ions, metal ions and sulfuric acid at an elevated temperature and continuing the contact to form an extraction mixture slurry, including a liquid component comprising an aqueous solution containing extracted nickel and iron from the comminuted minerals dissolved therein and a solid tailings component; and, separating the liquid and solid components of the extraction mixture slurry.

4 Claims, 1 Drawing Figure

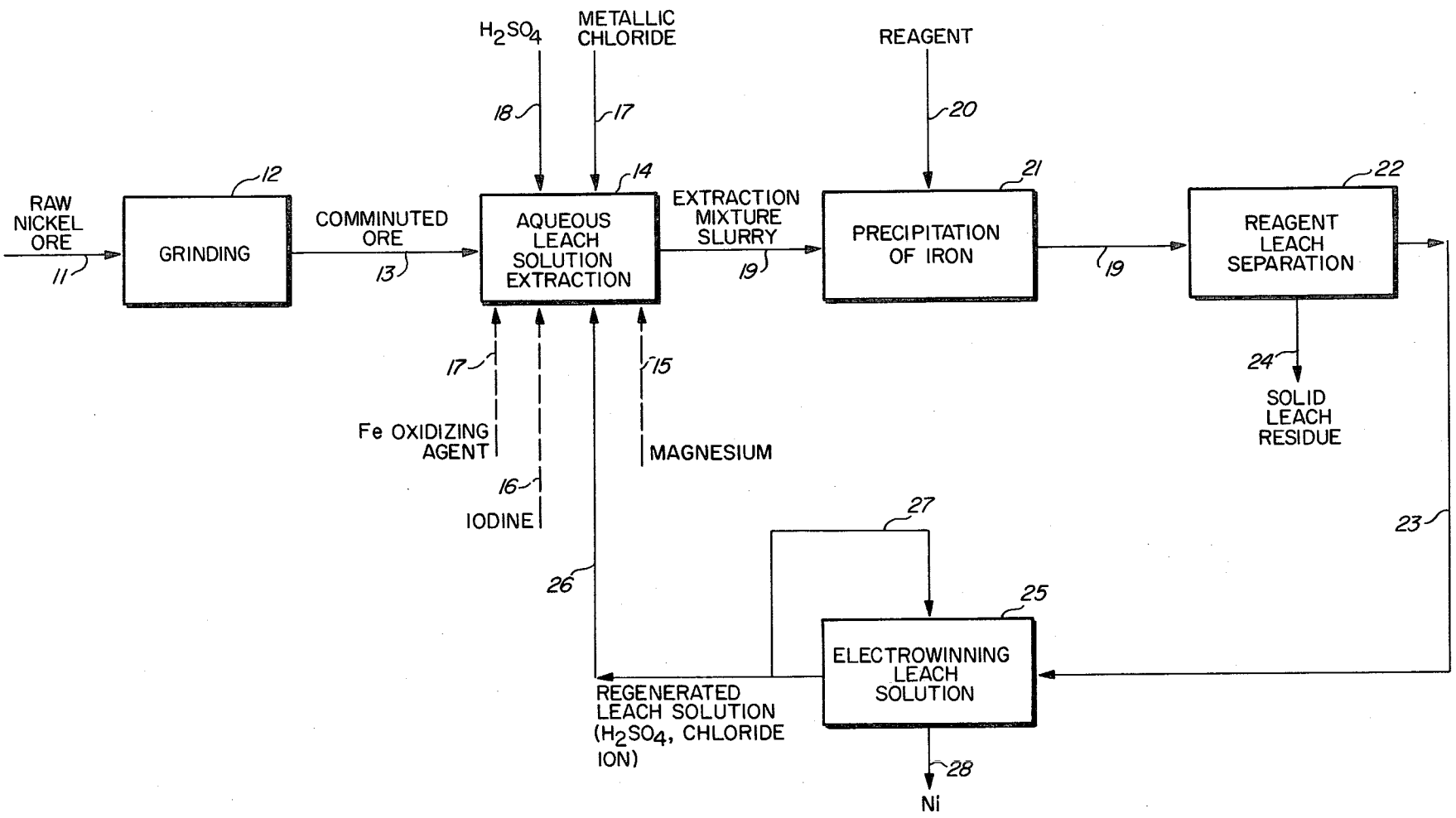
RAW NICKEL ORE
11
GRINDING
12
COMMINUTED ORE
13
$H_2SO_4$
18
METALLIC CHLORIDE
17
AQUEOUS LEACH SOLUTION EXTRACTION
14
Fe OXIDIZING AGENT
17
IODINE
16
MAGNESIUM
15
EXTRACTION MIXTURE SLURRY
19
REAGENT
20
PRECIPITATION OF IRON
21
19
REAGENT LEACH SEPARATION
22
SOLID LEACH RESIDUE
24
23
ELECTROWINNING LEACH SOLUTION
25
Ni
28
27
REGENERATED LEACH SOLUTION ($H_2SO_4$, CHLORIDE ION)
26

HYDROMETALLURGICAL PROCESS FOR EXTRACTION OF NICKEL

This application comprises a Continuation-In-Part of my co-pending application for "Hydrometallurgical Process For Extraction of Nickel", Ser. No. 275,763, filed June 22, 1981.

This invention relates to a process for extracting nickel from nickel bearing ores.

More particularly, the invention concerns a process for extracting nickel from nickel oxide ores such as laterites and serpentines without having to roast or convert the oxide ores to sulfide ores for extraction.

In another respect the invention relates to an essentially pollution-free hydrometallurgical process for extracting nickel in which leach solution used to extract nickel values from nickel ores may be recovered and re-cycled for further extraction.

Extraction of nickel from nickel-bearing ores has generally been accomplished from sulfide ores. Metallurgists have known for years that nickel oxide ores, such as laterites and serpentines, are not amenable to standard benefaction techniques due to the manner in which the nickel content of the ore is chemically held. To date, a commercially feasible means of extracting a majority of the nickel in laterite and silicate ores has apparently not been developed. Since the dissemination of nickel in oxide ores prevents physical concentration of nickel values by normal methods, metallurgists have attempted various other pyrometallurgical extraction procedures.

In general, commercial pyrometallurgical techniques employed today use either a combination of melting and sulfidizing to obtain phase separation of iron-nickel matte, or melting and reduction to obtain phase separation as iron-nickel metal from gangue. Treatment of oxide ores which have as high as 50% total water content and substantial quantities of high melting components requires large amounts of energy, thus making it economically unattractive to extract nickel by typical pyro metallurgical techniques. Leaching of the nickel from the ore by hydrometallurgical techniques has been achieved selectively where the nature of the feed is changed or special temperature and pressure conditions employed. By one process, nickel is selectively reduced to metal, then leached with an ammoniacal solution. By another process, sulfuric acid is used to leach the ore directly at elevated temperature and pressure to dissolve nickel and cobalt. Reference may be made to U.S. Pat. No. 3,130,043, which discloses the recovery of nickel from laterite ores by leaching the crushed ore with sea water to which sulfuric acid is added. Recovery of the nickel is only about 30%. U.S. Pat. No. 3,453,101 discloses a method of recovering nickel from laterite ores by first mixing the ore with a chloridizing agent, such as sodium chloride in powder form, and a reducing agent, such as coke, and roasting the mixture. The roasted ore is then suspended in water and a metallic salt having a lower ionization tendency than nickel is added to precipitate the metal on the surface of the metallic nickel formed in the roasting step. The nickel is thereafter recovered by convention flotation or magnetic separation processes. British Pat. No. 1,006,525 discloses the use of sea water as a sulfation promotion agent in a process for recovering nickel and cobalt values from laterite ores which involves a roasting operation. U.S. Pat. No. 3,551,645 discloses treatment of low-grade ores with amine-type chelating and sequestering agents to extract trace elements.

All of the known processes for recovery of nickel from nickel oxides have a number of deficiencies, primarily high cost and the necessity for specific types of mineral deposits, such as those deposits having a nickel content of 1% or better, or those that have other ore values mixed therein which can be recovered to aid in defraying the cost of recovery of the nickel metal. The pyrometallurgical processes used today are coming under increased attack due to substantial pollution of the atmosphere with sulfur dioxide and other gases. Effluents from these plants are often hazardous to plant and animal life.

In accordance with the invention, I have now discovered a hydrometallurgical process for extracting nickel from ores containing nickel in oxide form or from ores or materials in which nickel is reduced to an extractable form by the process described. My improved method of extraction is an essentially pollution free hydrometallurgical process through which nickel can be recovered from low grade laterite ores and materials without having to pre-treat the ore. The leach solution produced during the process can be used directly by conventional electrowinning systems and can be recovered and recycled for repeated extraction of nickel from oxide ore. The improved process further provides a means for producing a nickel rich leach solution having a minimal amount of iron, a contaminant which can seriously impair the electrowinning of nickel from the leach solution. A majority of the nickel contained in complex oxide ore generally considered unmanageable by present commercial and technical standards can be extracted from such ore by utilizing my improved hydrometallurgical process.

In my improved process, I contact comminuted nickel bearing ore with an aqueous solution containing stoichiometric amounts of chloride and metal ions necessary to displace nickel contained in the ore. A sufficient volume of sulfuric acid is included in the leach solution to achieve a pH of 1–2. Magnesium ions are present in the leach solution in a concentration of approximately one magnesium ion per each nickel atom or ion contained in the comminuted ore in the leach solution/ore slurry. The leach solution/ore slurry is stirred at a temperature ranging from ambient to just below the vaporization temperature of the mixture at atmospheric pressure for a time sufficient to extract and dissolve the major portion of nickel contained in the ore. The leach solution is then separated from the solid ore residue and processed to remove nickel values therefrom.

DESCRIPTION OF THE DRAWING

The drawing depicts a process for treating raw nickel oxide ores with chloride and metal ions to produce nickel.

The drawing illustrates an overall process for producing nickel from nickel oxide ores like laterite or serpentine. Nickel bearing oxide ore is ground 12 to at least 80% minus 80 mesh standard screen U.S. Sieve Series.

Grinding the ore even finer is preferable as long as it is economically feasible. For a particular ore material and treating facility, the optimum degree of grinding may be determined by balancing the cost of effecting increasingly finer particle size against the economic benefit of the resulting reduced retention time. It is preferred to grind the nickel containing ore to at least 90% minus 100 mesh, U.S. Standard Sieve Screen Series. This may be accomplished in an attrition-type mill, such as a ball or rod mill.

Comminuted ore 13 is then subjected to aqueous leach solution extraction step 14 in which ore 13 is slurried with an aqueous solution rich in chloride ions, such as a brine (sodium chloride) solution containing from 10% to 20%, by weight, sodium chloride. A metallic chloride 17 capable of displacing the nickel values in the ore is added to the aqueous brine solution. Cupric chloride, aluminum chloride and zinc chloride are preferred. This is ideally done on a continuous basis in a separate slurry make-up step in which the ore particles are dispersed in the aqueous solution at atmospheric temperature and pressure. The relative quantities of ore and aqueous carrier solution are adjusted and the adjusted slurry fed continuously to a reaction vessel in which the leaching reaction is conducted. The process may also be conducted on a batch-wise basis, with the slurry make-up and leaching operations carried out in the leaching vessel; however, the operating economics of the continuous process are generally more favorable.

The amount of metal salt 17 capable of displacing nickel values in the ore added to the leaching solution is, preferably, an amount equal to or more than the stoichiometric amount necessary for replacing the nickel contained in the ore. The amount of metal chloride in the leach solution of the ore/leach solution slurry is usually sufficient to provide one metal ion for each nickel atom contained in the ore of the ore/leach solution slurry. The presence of magnesium ions in the leach solution in admixture with one of the other metal ions ($Cu^{+2}$, $Zn^{+2}$ or $Al^{+3}$) appears to enhance recovery of nickel values from the ore. A sufficient amount of magnesium 15 may be found in the ore itself or supplemental amounts of magnesium may have to be added to the ore/leach solution slurry in the form of magnesium salts such as magnesium sulfate. The amount of magnesium 15 present in the leach solution may, depending on the weight percent of nickel contained in the comminuted ore, be up to 10% or more by weight, of the total weight of the leach solution but for many nickel ores is in the range of 6 to 10% by weight of the weight of the leach solution. Iodine could be utilized in place of or in combination with magnesium.

An oxidizing agent 17 may be added to the leach solution, the oxidizing agent acting to oxidize all or a portion of the iron contaminant of the ore. Oxidizing agents 17 which may be used include oxygen, sodium hypochlorite, calcium hypochlorite, potassium hypochlorite and manganese dioxide. The amount of oxidizer added depends on a number of factors but generally is added at approximately 1%, by weight, of the ore/leach solution slurry. It is preferred also to add a small amount of iodine 16 to the leach solution. The exact function of iodine is not clearly understood, but it appears to enhance nickel recovery by its presence.

After the particles of ore, or nickel containing material have been slurried together with the aqueous brine solution, sulfuric acid or sulfurous gases which yield sulfuric acid 18, are added to the leach solution. Sufficient sulfuric acid is added to bring the pH of the leach solution to approximately 1–2. Too much sulfuric acid 18 appears to dissolve substantially more iron into the leach solution than dissolves when the pH of the leach solution is maintained at approximately pH 1–2. After addition of sulfuric acid 18, the extraction mixture slurry is agitated by suitable means for a period of time to recover the major portion of nickel contained in the material. An exothermic reaction ensues which increases the temperature beyond ambient to as high as 60° C. to 80° C. Leaching of the nickel values from the ore can be carried out at temperatures ranging from ambient up to just below the vaporization temperature of the mixture. It is possible to utilize higher temperatures with pressure vessels; however, more iron contamination is encountered as well as added expense. The preferred temperature range during leaching is from 80° C. to 100° C. at atmospheric pressure. When sulfuric acid 18 is added, the temperature of the leach solution generally rises about 15° C. to 20° C. beyond the previous temperature of the solution. The pH of the solution is approximately pH3 when the chemical reactions taking place during solubilization are complete. These are a number of complex reactions which take place within the extraction vessel which result in recovery of the major portion of nickel contained in the raw ore. It is preferred not to use temperatures lower than 30° C. to 35° C. Once solubilization of nickel has taken place, the temperature of the slurry decreases its normal ambient range.

The raw ore can be ground or reduced in a mill, such as a pebble or a rubber-lined ball mill, together with the aqueous brine solution to which the metal chloride or salts 17 and oxidizing agents have been added, along with a portion of sulfuric acid 18 to initiate the chemical reaction prior to the final leaching step. In such case the grinding mill is lined with ceramic or rubber to prevent the leaching solution from attacking the lining of the mill. Special steel alloys are also available for preventing attack by the leaching solution. In make-up of the aqueous brine solution, it is advantageous to increase the chloride ion content to 120 to 180 grams per liter, or 10% to 15%, by weight. The result of this is apparently to speed the recovery of nickel from the ore-bearing material.

It is generally desirable to operate at a pulp density within the range of 20% to 50%. The reaction rate is reduced as pulp density is increased beyond the level where optimum dispersion of the solid ore in the solution can be maintained.

The pressure at which the leaching reaction is carried out is preferably atmospheric although, as indicated earlier, super or sub-atmospheric pressures may be used.

The leaching reaction is carried out until substantially all of the nickel in the ore has been displaced and solubilized by the metal chloride or salts 17 and the available acid has been consumed. After this time, the extraction mixture slurry 19 is discharged. If carried out on a continuous basis the extraction mixture slurry is discharged at a rate sufficient to balance the rate of slurry fed to the reaction vessel. The discharged slurry 19 comprises a solid leach residue and an aqueous chloride leach solution containing dissolved nickel, dissolved iron, and small amounts of the other non-ferrous materials which are taken into solution under the leaching conditions. A neutralizing reagent 20 is preferably added to raise the solution pH sufficiently to precipitate the dissolved iron 21 in the solution with the solid leach residue. Calcium carbonate, calcium hydroxide or other bases may be employed.

The aqueous slurry 19 is then treated 22 to separate the leach solution 23 from the solid leach residue and precipitated iron 24 by suitable liquid-solid separation processes which do not constitute a part of this invention. As an example of one liquid-solid separation process, the slurry 19 is subjected to thickening and filtration. The leach solution 23 and wash water containing dissolved nickel may then be fed to an electrowinning operation 25 where the solution is treated to recover nickel by electrolysis or direct reduction. The liquor 26 from the electrowinning operation contains regenerated sulfuric acid and chloride ion equivalent in amount to the portion of the nickel 28 recovered as elemental nickel and can be recycled 27 to the leaching operation. The washed leach residue from the liquid-solid separation, if it still contains some nickel values, may be repulped in water to provide a slurry for reprocessing. The tailings from leaching of nickel-bearing laterite ores are useful as a soil amendment as they contain ferric sulfate, potassium sulfate, and trace elements, such as manganese and chromium. The tailings may be discarded or treated to recover other such metallic values. If the leach solution contains too high a concentration of dissolved iron, the iron may be separated by suitable conventional liquid-liquid extraction processes or by precipitation of the iron with a basic substance such as sodium hydroxide or ammonium hydroxide, raising the pH of the leach solution to pH4–5 to precipitate the iron as iron hydroxide.

The leach solution 23 containing dissolved nickel may be fed directly to an electrowinning operation where the leaching liquor is used as the electrolyte for recovery of elemental nickel as explained previously. It is desirable, however, to concentrate the leach solution prior to electrowinning. This is best done by an ion exchange process using a cation exchange resin. The leach solution containing dissolved nickel is passed through a cation exchange resin in its acid form for replacement of the hydrogen ions in the resin by nickel. The nickel is elluted by passing a strong acid, such as sulfuric acid, through the ion exchange column to ellute the nickel held by the resin as nickel sulfate, which may be fed directly to an electrowinning operation.

Recoveries of greater than 70% have been accomplished of nickel from laterite and other complex silicate ores by the process described.

The process of this invention is applicable to either high or low-grade materials containing primarily nickel oxide, or ores containing nickel which are reduced to oxide by the process of this invention and made soluble in the leach solution. Laterite and serpentine ores, generally considered to be low grade material, are well adapted to the process of this invention. It is to be understood, however, that use of the term "complex oxides" or "oxides", herein is intended to include such materials and include any other high or low grade ore materials which contain iron and economically recoverable quantities of nickel in complex oxide form.

The addition of certain metal chlorides to the leach solution is an important part of the process of the invention. The metal chlorides, in particular zinc, aluminum and cupric chloride, appear to function as catalysts which actively promote the various chemical reactions causing the breakdown of the nickel ore. Absence of a metal chloride catalyst from the leach solution can markedly limit the effectiveness of the hydrometallurgical process of the invention.

Similarly, the addition of a hypochlorite to the leach solution is also an important step in the process. It is believed the hypochlorite maximizes the effectiveness of the process by providing a ready supply of free chlorine ions in solution.

As noted, the leach comminuted ore extraction mixture slurry solution should contain sufficient magnesium so that there is at least one magnesium ion in the slurry for each nickel atom found in the comminuted ore in the extraction mixture slurry. Although sea water contains magnesium, the small proportion of magnesium found in sea water is not sufficient to effectively break down many nickel ores. When either sea water or normal "tap" water is utilized to form the extraction mixture slurry of ore and leach solution, a sufficient amount of magnesium must be contained in the ore being processed or be added to the extraction mixture slurry. The ratio of magnesium ions to nickel atoms in the ore/leach solution slurry can be 1:4 to 4:1, or even more than 4:1, for instance 5 or 6:1. However the most efficient, economical ratio of magnesium ions to nickel atoms appears to be 1:1.

The following examples are presented, not by way of limitation of the scope of the invention, but to illustrate to those skilled in the art the practice of various of the presently preferred embodiments of the invention and to distinguish the invention from the prior art.

EXAMPLE 1

An aqueous solution rich in chloride ion was prepared by adding to 100 ml. of water, 150 gm. sodium chloride, 100 ml. of a 14%, by weight, solution of sodium hypochlorite and 10 gm. or cupric chloride. To this solution was added 300 gm. of minus 80 mesh nickel ore assayed as containing about 0.47% by weight nickel. The solution had a pH of about 7 and was at room temperature. After addition of the ore to the aqueous solution 70 ml. of commercial grade sulfuric acid were added, sufficient to reduce the solution to pH to 1. The ensuing exothermic reaction raised the temperature of the slurry to about 60° C. The mixture was agitated with a variable speed mixer for about 24 hours. At the end of this time, the temperature had dropped to ambient.

The leach solution was filtered from the leach residue through a Buchner funnel. The pregnant liquor, or leach solution, had a pH of 1 and contained 0.74 g/l nickel. The filtered solids were not washed but dried and assayed at a nickel content of 0.16%.

EXAMPLE 2

A leach solution was prepared by adding to 100 ml. of water 150 gm. of sodium chloride (iodized), 100 ml. of a 14%, by weight, solution of sodium hypochlorite and 4 gm. of aluminum chloride ($AlCl_3.6H_2O$). The temperature of the leach solution was about 35° C. The solution was placed in a 1500 ml. beaker and 300 gm. of nickel silicate ore, assaying 0.47% nickel, added thereto, the ore being previously crushed to minus 80 mesh. After addition of the ore to the leach solution, the pH of the solution was neutral. The sodium chloride was 1% by weight iodine.

To the above slurry was added 75 ml. of commercial sulfuric acid, sufficient to reduce the pH of the solution to pH 1. After addition of the acid, the temperature of the slurry rose to about 60° C. Samples of the leach solution were taken for assay during the leaching period and gave the following results:

TABLE A

| Leaching Time | Nickel, g/l | Iron, g/l | Aluminum, g/l |
|---|---|---|---|
| 2 hr | 0.75 | 4.05 | 0.31 |
| 16 hr. | 0.84 | 0.78 | 0.72 |

TABLE A-continued

| Leaching Time | Nickel, g/l | Iron, g/l | Aluminum, g/l |
|---|---|---|---|
| 24 hr. | 0.96 | 0.30 | 0.26 |

After 24 hours of slow agitation, the pregnant liquor was filtered from the leach residue and the residue washed with 100 ml. of water. The liquor had a pH of 3–4. The first wash liquor was assayed for metal content and contained 0.20 g/l nickel, 1.85 g/l iron and 0.05 g/l aluminum, indicating that some solubilized nickel was occluded to the leach residue. The leach residue was washed a second time with the same amount of water and again assayed, giving 0.07 g/l nickel, 0.52 g/l iron and 0.02 g/l aluminum, indicating that essentially all the solubilized nickel was removed during the first wash.

The solid leach residue was filtered, dried and assayed, the assay showing 0.14% nickel and 4.80% iron, indicating over 70% efficiency recovering nickel from low-grade silicate nickel-ferrous ores.

The leach solution, after concentration by passage through an ion exchange column, produced an enriched nickel electrolyte solution for nickel cathode production or for solvent extraction to produce the nickel metal by electrowinning.

EXAMPLE 3

A leach solution processed from nickel-bearing ore containing 0.47% by weight nickel contained 0.96 g/l nickel, 0.30 g/l iron and 0.26 g/l aluminum. This leach solution was treated with sufficient ammonium hydroxide to raise the pH to 6–7. After pH 4 was reached, a few drops of sodium hydroxide were added to increase the pH and precipitate the iron dissolved in the leach solution. The solution was filtered and the precipitated iron and aluminum separated, leaving essentially a nickel chloride solution. An ion exchange column containing a cation exchange resin (C-20 of the Diamond Shamrock Corporation) in acid form was treated with 300 ml. of the nickel-containing leach solution. The ion exchange column extracted approximately 80% of the nickel in the solution as determined by the nickel concentration in the influent and effluent. When the effluent started showing the presence of nickel, the flow through the column was stopped and the column drained. The resin bed was then washed with 300 ml. of water, allowing the last of the water to just cover the top of the column bed. The nickel was then eluted by passing 200 ml. of 8%, by weight, sulfuric acid through the column to displace the nickel. After the nickel was washed from the bed, a water wash did not show a trace of nickel, indicating complete recovery of the nickel in the effluent solution.

EXAMPLE 4

Recovery of nickel was carried out as described in Example 1 using zinc chloride in place of cupric chloride. Similar results were obtained.

EXAMPLE 5

A nickel basic rock from the Gasquet Mountains of Northern California was analyzed by qualitative spectrographic analysis and contained the following:

TABLE A

| Element | Approximate Percent |
|---|---|
| Silicon | Major Constituent |
| Aluminum | 0.07 |
| Manganese | 0.1 |
| Magnesium | 9.0 |
| Chromium | 0.3 |
| Antimony | 0.05 |
| Iron | 7.0 |
| Vanadium | 0.003 |
| Copper | 0.007 |
| Titanium | 0.001 |
| Nickel | 0.5 |
| Potassium | 2.0 |

The ore was ground to minus 80 mesh and 100 gm. of the ore slurried with a 15% sodium chloride solution containing 10 gm. cupric chloride heated to 85° C. About 15 gm. of concentrated sulfuric acid were added to the slurry. The solution was agitated periodically. After about 20 minutes the solution was decanted through a hot Buchner funnel and the filter bed washed with 100 ml. of hot water. Five gm. calcium hydroxide was added to 25 gm. of the filtrate solution and tested with dimethylgloximine after adjustment of the pH to about 9.

A second test was carried out with the addition of sufficient sulfuric acid to reduce the pH of the solution to pH 1. The resulting leach solution was filtered and treated with calcium peroxide to reduce the pH to the point where nickel showed positive by the gloximine test.

The tails from the first test were washed with 300 ml. of water and dried in an oven at 250° C. for two hours and then assayed. The nickel content was approximately 0.10% by weight. The leach solution contained 1.6 g/l free acid, 1.9 g/l iron and 0.6 g/l nickel. The wash solution contained 14 g/l free acid, 0.2 g/l iron and 0.03 g/l nickel, evidence that control of the pH to around 1 effects the extraction of nickel with minimum contamination of iron. Without control of the pH, about as much iron is extracted as nickel.

In the second test, where the pH is not controlled, the nickel extraction dropped substantially while the iron concentration remained almost constant. The second test also showed substantially less free acid, indicating a necessity to control the pH for adequate extraction of the nickel from the silicate rock.

EXAMPLE 6

A solution of 1000 ml. of water, 150 gms. sodium chloride, 100 ml 14% by weight sodium hypochlorite, 5 gms. aluminum chloride ($AlCl_3$ $6H_2O$) and 18 gms. magnesium sulphate was prepared and heated to 85° C. To this mixture was added 300 gms. of minus 80 mesh laterite soil from the Gasquet Mountain region of Northern California assayed as follows:

TABLE A

| Element | Red Laterite |
|---|---|
| Boron | 0.01 |
| Silicon | Major Constituent |
| Aluminum | 3.0 |
| Manganese | 0.1 |
| Magnesium | 4.0 |
| Chromium | 0.6 |
| Iron | Intermediate Constituent |
| Calcium | 0.4 |
| Vanadium | 0.008 |
| Copper | 0.01 |
| Sodium | 0.05 |
| Titanium | 0.04 |
| Silver | 0.001 |

TABLE A-continued

| Element | Red Laterite |
|---|---|
| Zirconium | 0.1 |
| Nickel | 0.7 |
| Potassium | 0.5 |

The solution had a pH of 7. To this was added 70 ml of commercial grade sulfuric acid to reduce the pH to solution to pH1. When the acid was added a violent reaction took place raising the temperature to 105° C. Three gms. of activated charcoal was added as a defoaming agent and the extraction continued.

The mixture was agitated for one hour with samples taken after 15 minutes, 30 minutes and one hour. Determination of the nickel content of the samples all showed progressive extraction of nickel.

At the end of one hour the slurry, prior to filtration, was treated with calcium carbonate to raise the pH from pH3 to pH5 and the liquid filtered from the leach residue. The liquor was tested for nickel and gave a strong reaction with dimethylgloximine. The tails were washed with 300 ml of water. The wash liquor showed a trace of nickel after the pH was raised to pH5 to precipitate the dissolved iron.

The pregnant liquor was tested for iron with an iron chelating agent. No reaction was observed indicating that essentially all the iron was removed along with the leach residue.

In Examples 1–6 the ore/leach solution slurries contained at least one ion of magnesium for each atom of nickel contained in the ore. If the leach solution ore slurry does not contain magnesium substantially reduced amounts of nickel are leached from the ore.

Having described my invention in such terms as to enable those skilled in the art to understand and practice it and having identified the presently preferred embodiments thereof, I claim:

1. A hydrometallurgical process for extracting nickel from raw nickel oxide-laterite ore comprising the steps of (a) contacting said comminuted nickel bearing minerals in an extraction zone with an aqueous solution containing stoichiometric amounts of metal and chloride ions necessary to displace nickel contained in the ore and including
  (i) at least one oxidizing agent selected from the class of sodium hypochlorite, calcium hypochlorite and potassium hypochlorite;
  (ii) at least one metal chloride selected from the group consisting of aluminum chloride, cupric chloride, copper chloride and tin chloride,
  (iii) sodium chloride,
  (iv) sulfuric acid, and
  (v) magnesium
  at an elevated temperature and continuing said contact to form an extraction mixture slurry including
  (vi) a liquid component comprising an aqueous solution containing extracted nickel from said comminuted minerals dissolved therein, and
  (vii) a solid tailing component, and
(b) separating said liquid and components of said extraction mixture slurry.

2. The process of claim 1 wherein the ration of magnesium ions contained in said aqueous leach solution to said nickel atoms contained in said ore contacted with said aqueous leach solution is greater than 1:4.

3. The process of claim 2 wherein a minor effective amount of iodine is added to said extraction mixture slurry.

4. The process of claim 1 wherein said aqueous solution includes 10% to 20% by weight of said sodium chloride.

* * * * *